US006120272A

United States Patent [19]

Gallardo

[11] Patent Number: 6,120,272

[45] Date of Patent: Sep. 19, 2000

[54] PUMP-MOTOR FOR FLUID WITH ELLIPTICAL MEMBERS

[76] Inventor: Arturo Gallardo, 7 Bermondsey Rise N.W., Calgary, Alberta, Canada, T3K 1V1

[21] Appl. No.: 09/131,783

[22] Filed: Aug. 10, 1998

[51] Int. Cl.[7] ..... F04C 18/00

[52] U.S. Cl. ..... 418/240; 418/243; 418/248; 418/247; 418/189

[58] Field of Search ..... 418/240, 243, 418/248, 247, 189

[56] References Cited

U.S. PATENT DOCUMENTS

| | | | |
|---|---|---|---|
| 1,672,422 | 6/1928 | Nelson | 418/248 |
| 1,701,792 | 2/1929 | Nelson | 418/248 |
| 3,583,371 | 6/1971 | King . | |
| 3,753,628 | 8/1973 | Becker . | |
| 3,994,638 | 11/1976 | Garland . | |
| 4,073,605 | 2/1978 | Wakeman . | |
| 4,183,723 | 1/1980 | Hansen et al. . | |
| 4,202,657 | 5/1980 | Kice . | |
| 4,214,855 | 7/1980 | Gerritsen . | |
| 4,251,190 | 2/1981 | Brown et al. . | |
| 4,251,192 | 2/1981 | Clark . | |
| 4,289,454 | 9/1981 | Iwata . | |
| 4,385,874 | 5/1983 | Savoie, Jr. . | |
| 4,452,571 | 6/1984 | Koda et al. . | |
| 4,521,164 | 6/1985 | Tuckey . | |
| 4,621,986 | 11/1986 | Sudo . | |
| 4,715,800 | 12/1987 | Nishizawa et al. . | |
| 4,726,740 | 2/1988 | Suzuki et al. . | |
| 4,844,708 | 7/1989 | Lopez . | |
| 4,929,159 | 5/1990 | Hayase et al. . | |
| 5,074,761 | 12/1991 | Hirooka et al. . | |
| 5,226,803 | 7/1993 | Martin . | |

*Primary Examiner*—Thomas Denion
*Assistant Examiner*—Thai-Ba Trieu
*Attorney, Agent, or Firm*—David S. Thompson

[57] ABSTRACT

A pump or motor 10 provides a housing 20 which carries one or more elliptical drivers 40 which rotate freely with an axle which is rotatably carried by the housing. One V-shaped rocker 60 is associated with each elliptical driver, and moves in an oscillatory motion in response to being driven by the associated elliptical driver. When used as a motor, fluid entering the housing tends to apply pressure to one side of the elliptical driver, while the other side is shielded from pressure by the V-shaped rocker. Uneven pressure causes the elliptical driver to rotate. As the elliptical driver rotates, the V-shaped rocker oscillates in a period manner at twice the frequency of the elliptical driver. The vertical height of the V-shaped is determined by an adjustable support 80, which allows regulation over the friction level and fluid seal between the rocker and the elliptical drive, and which allows adjustment to compensate for wear of the surfaces of contact between the rocker and the elliptical driver.

5 Claims, 2 Drawing Sheets

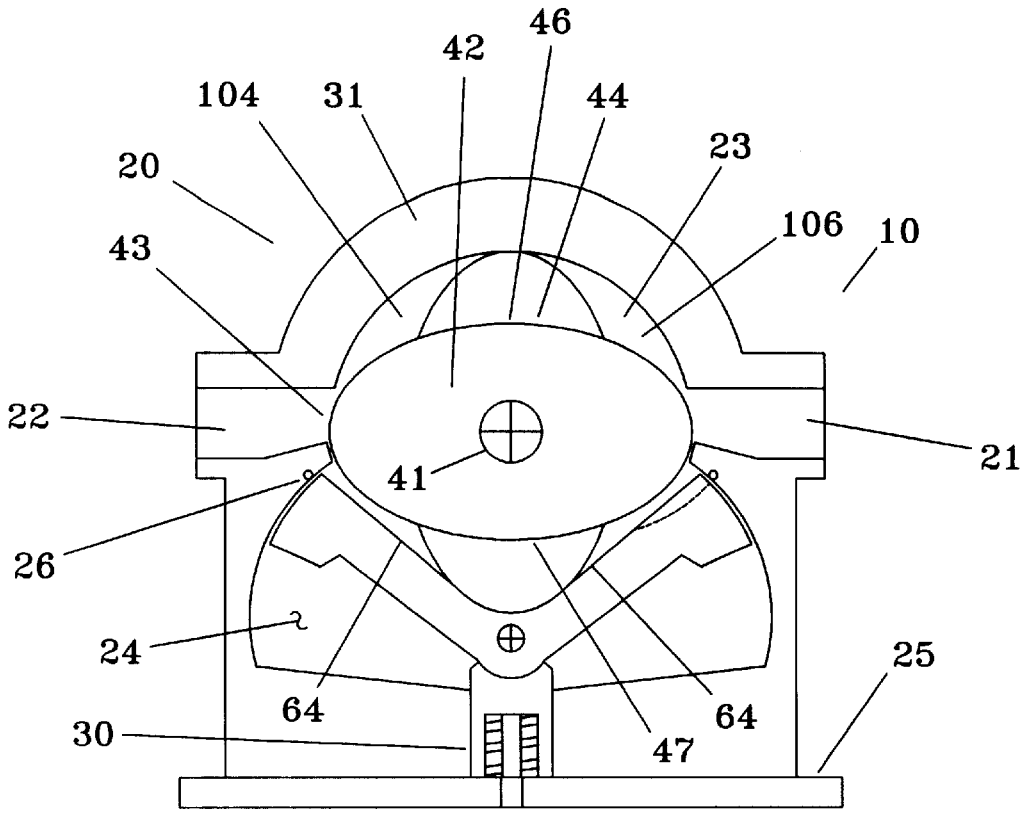
FIG. 1
FIG. 2
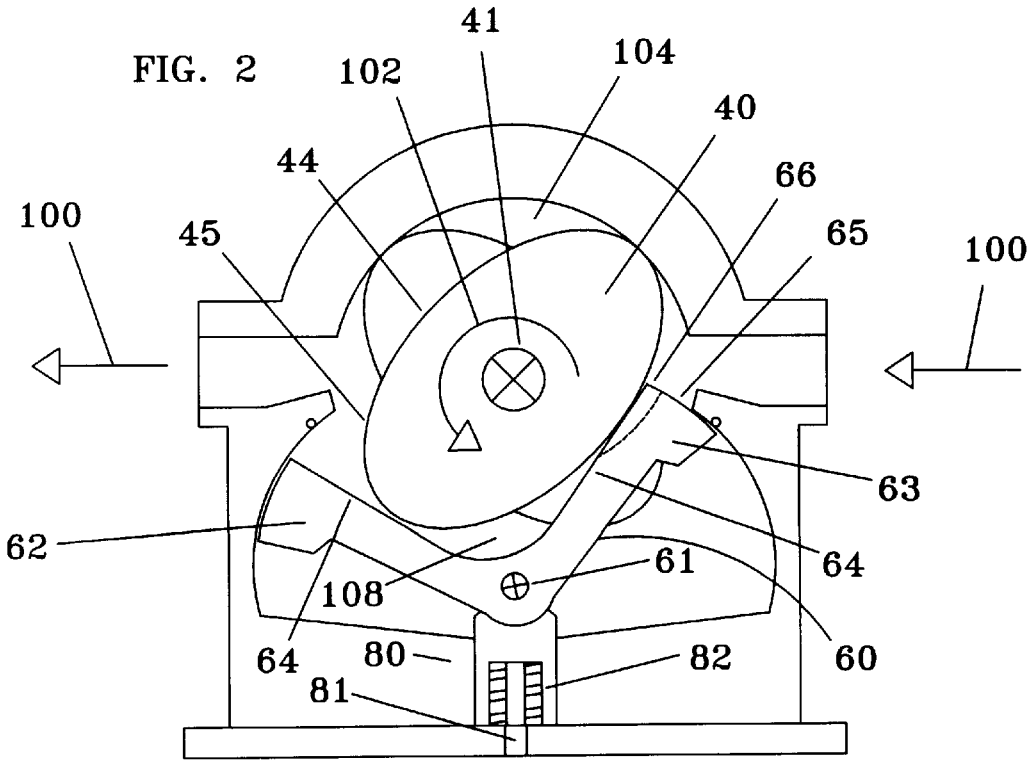

PUMP-MOTOR FOR FLUID WITH ELLIPTICAL MEMBERS

CROSS-REFERENCES

There are no applications related to this application filed in this or any foreign country.

BACKGROUND

A variety of pumps and motors are known. Most provide impellers, pistons or turbines to drive, or be driven by, fluid. Each of these designs have advantages and disadvantages. In some motor applications, power is lost due to a failure to adequately harness the energy of the driving fluid. In some impeller type pump applications, fluid may tend to slip past impeller vanes, particularly where the pressure differential is great. In applications using pistons, fluid is less likely to slip past the piston without driving, or being driven by the piston. However, friction between piston rings and cylinders tends to decrease efficiency of these applications.

What is needed is an apparatus that is adapted for use as a pump or motor that combines the advantages of impellers and turbines with the advantages of pistons, while minimizing the disadvantages of both.

SUMMARY

The present invention is directed to an apparatus that satisfies the above needs. A novel device adapted for use as a pump or generator provides some or all of the following structures.

(A) A housing, having a fluid inlet and a fluid outlet, defines an upper cavity and a lower cavity.

(B) A drive axle, supported by bearings is carried by the housing.

(C) One or more elliptical drivers are carried by the drive axle within the upper cavity of the housing.

(D) A rocker having left and right arms is carried within the lower cavity of the housing. An upper edge surface of the arms of the rocker provides an elliptical driver contact surface, which is in contact with a portion of the peripheral edge of the elliptical driver and which tends to cause fluid pressure to be greater on one side of the elliptical driver than the other, thereby resulting in rotary motion of the elliptical driver. The rocker also provides a housing contact surface, which tends to prevent fluid from flowing in the reverse direction. A pressure release channel, defined in the rocker arm adjacent to the fluid outlet allows the release of fluid carried between the rocker and the elliptical driver.

(E) An adjustable support, carried by the housing, supports the rocker at an elevation which provides the best combination of leak-free and low-friction contact with the elliptical driver, and allows for adjustment to compensate for wear of the elliptical driver contact surface.

It is therefore a primary advantage of the present invention to provide a novel apparatus which may be used either as a pump or motor, and which is efficient in either application.

Another advantage of the present invention is to provide a novel pump or motor that is not dependent on impellers, turbines or pistons, and which provides a unique combination of elliptical drivers and a rocker which interact efficiently.

A still further advantage of the present invention is to provide a novel pump or motor having a rocker that is adjustable vertically, so that the rocker may be elevated to compensate for wear on its upper surface.

DRAWINGS

These and other features, aspects, and advantages of the present invention will become better understood with regard to the following description, appended claims, and accompanying drawings where:

FIG. 1 is an axial cross-sectional view which shows an elliptical driver where fluid is just about to exit from the outlet port.

FIG. 2 is an axial cross-sectional view which shows an elliptical driver in the power stroke portion of the drive cycle.

Figure 3:
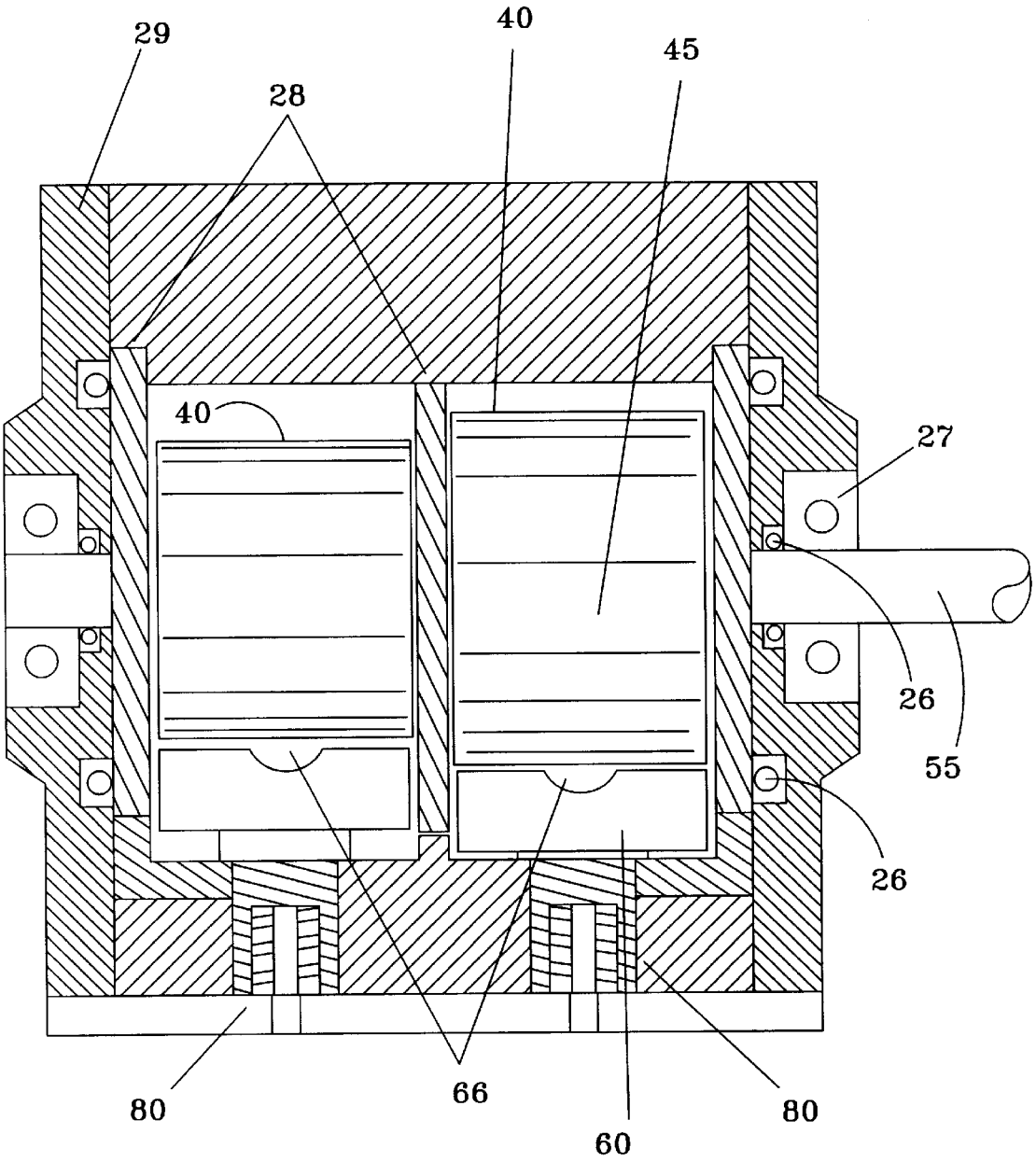

FIG. 3 a side partial cross-sectional view which shows two elliptical drivers in different stages of the drive cycle.

DESCRIPTION

Referring generally to FIGS. 1 through 3, a pump or motor 10 constructed in accordance with the principles of the invention is seen. The terms pump and motor are used synonymously, to indicate the same type of structure, wherein the device would operate as a pump where rotary motion is applied to the axle, and as a motor where compressed or pressurized fluid was applied to a fluid inlet. The motor 10 provides a housing 20 which carries one or more elliptical drivers 40 which rotate freely with an axle which is rotatably carried by the housing. One V-shaped rocker 60 is associated with each elliptical driver, and moves in an oscillatory motion in response to being driven by the associated elliptical driver. When used as a motor, fluid entering the housing tends to apply pressure to one side of the elliptical driver, while the other side is shielded from pressure by the V-shaped rocker. Uneven pressure causes the elliptical driver to rotate. As the elliptical driver rotates, the V-shaped rocker oscillates in a period manner at twice the frequency of the elliptical driver. The vertical height of the V-shaped is determined by an adjustable support 80, which allows regulation over the friction level and fluid seal between the rocker and the elliptical drive, and which allows for adjustment to compensate for wear of the elliptical driver contact surface.

Referring to the drawings, the housing 20 carries one or more elliptical drivers 40 and associated V-shaped rockers 60, each having an adjustable support 80. A preferred version of the housing defines a fluid inlet 21 and fluid outlet 22, which corresponds to the direction of fluid flow 100 and the direction of rotation 102 of the elliptical driver. The housing further defines an upper cavity 23, which is sized for the support and operation of one or more elliptical drivers, and is therefore generally circular in cross-section. A lower cavity 24 is adjacent to the upper cavity and is sized to support a V-shaped rocker 60 associated with each elliptical driver. A base 25 supports the housing in typical installations.

Referring particularly to FIG. 3, a preferred version of the housing includes a main body 31 having open ends which are covered by end plates 29. The end plates define openings for a drive axle 55, and support bearings 27 which allow the axle to rotate freely.

The upper and lower cavities are segmented by rotary seal plates 28, which separate the interior of the housing into regions, wherein each region carries one elliptical driver 40 and one V-shaped rocker 60. The rotary seal plates are required since each elliptical driver is typically out-of-phase with adjacent elliptical drivers, and therefore undesired fluid flow would result in the absence of the seal plates.

Between the lower cavity and the base, a passage 30 is defined to carry each adjustable support 80.

Referring particularly to FIG. 3, a number of seals 26 provide a fluid-tight seal when the housing is assembled. The seals may be rubber or similar material, and may be O-rings or any similar known type of seal. Typically, seals are located between the end plates 29 and rotary seal plates 28, and between the end plates and drive axle 55.

Referring to FIGS. 1 through 3, the structure of the elliptical drivers 40 may be seen. One or more elliptical drivers function in related manners depending on whether the device is being used as a motor or as a pump. Where the device is functioning as a motor, the upper portion 46 of the peripheral edge surface 45 of the elliptical drivers is pushed by fluid flow 106 (liquid or gas) entering the housing through the fluid inlet 21. In contrast, the lower portion 47 of the peripheral edge 46 is comparatively unaffected by the fluid pressure because the housing contact surface 65 of the arm of the rocker adjacent to the fluid inlet tends to reduce fluid pressure. As a result, pressure on the fluid inlet side of the upper edge of the elliptical driver (as oriented in FIGS. 1 and 2) causes the elliptical driver to rotate in the direction indicated 42.

In the preferred embodiment of the invention, the elliptical drivers 40 have an elliptical cross-sectional shape. However, in a more general embodiment of the invention, the elliptical driver may be any similar non-round cross-sectional shape having a sharper curved end 43 and a move gently curved middle 44.

One or more elliptical drivers are carried by a center pivot hole 41 which is attached to the drive axle 55 in a manner that causes the drive axle to rotate when the elliptical drivers rotate. As a result, where the device is functioning as a pump, rotation of the axle causes fluid 104 to be forced out the fluid outlet. Fluid 106 is drawn in through the fluid inlet 21 as a result, and this fluid is similarly forced out the fluid outlet.

As seen in FIG. 3, where two or more elliptical drivers 40 used, the planar sides 42 are adjacent to rotary seal plates 28. This requires that fluid flow behave as disclosed above.

It is generally preferable to have at least two elliptical drivers, and that they be out-of-phase with each other. This prevents the circumstance where the device is used as a motor, but is perfectly balanced and fails to start. Keeping the elliptical drivers out of phase prevents both elliptical drivers from being balanced.

Referring particularly to FIGS. 1 and 2, the structure and function of the V-shaped rocker 60 may be seen. The rocker tends to cause fluid flow to travel about the elliptical driver opposite the rocker 60, through regions 104 and 106. As a result, fluid under pressure causes the elliptical drivers to rotate, and angular force applied to the elliptical drivers tend to drive fluid from the fluid inlet to the fluid outlet.

The V-shaped rocker oscillates two full cycles about a center pivot 61 for every one revolution of the associated elliptical driver. Starting from the position seen in FIG. 1, a 45 degree rotation of the elliptical driver causes the rocker to assume the position seen in FIG. 2. A further 45 degree rotation of the driver would cause the rocker to return to the position seen in FIG. 1, while the elliptical driver would be oriented with its major axis in the vertical direction. A further 45 degree rotation of the elliptical driver would cause the rocker to assume a position that is generally the mirror image of the position seen in FIG. 2. A still further 45 degree rotation of the elliptical driver would cause the rocker to return to the position seen in FIG. 1.

The V-shaped rocker provides left and right arms 62, 63 which together form a generally V-shaped elliptical driver contact surface 64 which contacts the peripheral edge 45 of the elliptical driver. The actual cross-sectional shape of the elliptical driver contact surface 64 may be parabolic, elliptical or a generally V-shape having a rounded vertex.

A housing contact surface 65 oscillates between contact with the housing, as seen in FIG. 1, and a position seen in FIG. 2, wherein the housing contact surface 65 tends to block fluid flow from traveling from the fluid inlet 21 to the fluid outlet 22 by means of a pathway below the center pivot 41 of the elliptical driver 40. In a preferred embodiment, a very narrow clearance exists between the housing contact surface 65 and the housing, thereby preventing actual contact and the associated friction. However, where less fluid leakage was desired, this clearance could be reduced, possibly resulting in a frictional contact between the surfaces.

A pressure relief channel 66 is defined in the arm (the right arm 63 of FIGS. 1 and 2) of the rocker that is adjacent to the fluid inlet 21. The pressure relief channel allows fluid 108 trapped below the elliptical driver to be transferred to location 106.

The adjustable support 80, seen in all figures, supports the center pivot 61 of the rocker 60. The adjustable support allows the distance between the center pivot 61 of the rocker 60 and the center pivot 61 of the elliptical driver 40 to be adjusted. Such adjustment is primarily of interest as the elliptical driver contact surface 64 of the rocker or the peripheral edge 45 of the elliptical driver wears. In such a circumstance, the adjustable support could be raised by means of pushing rods 81. Springs 82 bias the rocker to the elliptical driver, which tends to provide the correct amount of friction between the two. Some friction is needed to cause the seal between the two to be fluid-resistant.

The previously described versions of the present invention have many advantages, including a primary advantage of providing a novel apparatus which may be used either as a pump or motor, and which is efficient in either application.

Another advantage of the present invention is to provide a novel pump or motor that is not dependent on impellers, turbines or pistons, and which provides a unique combination of elliptical drivers and a rocker which interact efficiently.

A still further advantage of the present invention is to provide a novel pump or motor having a rocker that is adjustable vertically, so that the rocker may be elevated to compensate for wear on its upper surface.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while the invention has been described alternately as a pump or motor, it is clear that either is possible, and that the terms are largely synonymous. Similarly, while the rocker is illustrated below the elliptical driver, it is not required that this be the case, and an equivalent version of the invention could utilize a V-shaped rocker carried above the elliptical driver, and may therefore result in rotation or fluid flow in the opposite direction. And further, while the elliptical drivers and V-shaped rockers have been described in a preferred shape, orientation and relationship, it is clear that the elliptical drivers could be modified to other out-of-round configurations and the V-shaped rockers modified suitably to compensate. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A pump, comprising:

(A) a housing, having a fluid inlet and a fluid outlet, defining an upper cavity and a lower cavity;

(B) a drive axle carried by the housing;

(C) a first elliptical driver, carried by the drive axle within the upper cavity of the housing;

(D) a first rocker, carried within the lower cavity of the housing, having left and right arms, and having an elliptical driver contact surface in contact with a portion of a peripheral edge of the first elliptical driver;

(E) a second elliptical driver, carried by the drive axle within the upper cavity of the housing 90 degrees out-of-phase with the first elliptical driver; and (F) a second rocker, carried within the lower cavity of the housing, having left and right arms, and having an elliptical driver contact surface in contact with a portion of a peripheral edge of the second elliptical driver.

2. The pump of claim 1, further comprising first and second adjustable supports, carried by the housing, adjustably carrying the center pivot of the first and second rockers.

3. A pump, comprising:

(A) a housing, having a fluid inlet and a fluid outlet, defining an upper cavity and a lower cavity;

(B) a drive axle carried by the housing;

(C) an elliptical driver, carried by the drive axle within the upper cavity of the housing;

(D) a rocker, carried within the lower cavity of the housing, having left and right arms, and having an elliptical driver contact surface in contact with a portion of a peripheral edge of the elliptical driver; and (E) a pressure release channel, defined in the elliptical driver contact surface of the rocker arm adjacent to the fluid outlet, which allows the release of fluid carried between the rocker and the elliptical driver.

4. The pump of claim 3, further comprising an adjustable support, carried by the housing, adjustably carrying the center pivot of the rocker.

5. A pump, comprising:

(A) a housing, having a fluid inlet and a fluid outlet, defining an upper cavity and a lower cavity;

(B) a drive axle, supported by bearings carried by the housing;

(C) at least one elliptical driver, carried by the drive axle within the upper cavity of the housing;

(D) a rocker, carried within the lower cavity of the housing, comprising:

(a) left and right arms carried by a center pivot;

(b) an upper edge surface of the arms of the rocker having an elliptical driver contact surface in contact with a portion of a peripheral edge of the at least one elliptical driver, whereby the rocker tends to cause fluid pressure to be greater on a first side of the elliptical driver than on a second side of the elliptical driver, thereby resulting in rotary motion of the elliptical driver;

(c) a housing contact surface, adjacent to the housing, whereby fluid is prevented from flowing in a reverse direction; and (d) a pressure release channel, defined in the rocker arm adjacent to the fluid outlet, allows the release of fluid carried between the rocker and the elliptical driver; and (E) an adjustable support, carried by the housing, adjustably carrying the center pivot of the rocker.

* * * * *